US008251196B2

(12) United States Patent
Dietz et al.

(10) Patent No.: US 8,251,196 B2
(45) Date of Patent: Aug. 28, 2012

(54) SYSTEM CONSISTING OF BANK NOTE PROCESSING MACHINES, BANK NOTE PROCESSING MACHINE AND ASSOCIATED OPERATING METHOD

(75) Inventors: Jürgen Dietz, München (DE); Christoph Mätzig, Ampfing (DE)

(73) Assignee: Giesecke & Devrient GmbH, Munich (DE)

( * ) Notice: Subject to any disclaimer, the term of this patent is extended or adjusted under 35 U.S.C. 154(b) by 1039 days.

(21) Appl. No.: 10/584,051

(22) PCT Filed: Dec. 20, 2004

(86) PCT No.: PCT/EP2004/014508

§ 371 (c)(1), (2), (4) Date: Jan. 9, 2007

(87) PCT Pub. No.: WO2005/064550

PCT Pub. Date: Jul. 14, 2005

(65) Prior Publication Data

US 2007/0152034 A1 Jul. 5, 2007

(30) Foreign Application Priority Data

Dec. 23, 2003 (DE) ..... 103 60 861

(51) Int. Cl.
*G07F 7/04* (2006.01)

(52) U.S. Cl. ..... 194/206

(58) Field of Classification Search ..... 194/206, 194/217, 200; 700/32, 275, 279, 280; 705/305; 455/423; 902/37, 38; 209/534; 235/379; 340/635, 673, 679

See application file for complete search history.

(56) References Cited

U.S. PATENT DOCUMENTS

| | | | | |
|---|---|---|---|---|
| 5,311,562 | A * | 5/1994 | Palusamy et al. | 376/215 |
| 5,847,658 | A * | 12/1998 | Irie et al. | 340/683 |
| 5,984,178 | A * | 11/1999 | Gill et al. | 235/379 |
| 6,026,175 | A | 2/2000 | Munro et al. | |
| 6,363,164 | B1 * | 3/2002 | Jones et al. | 382/135 |
| 6,430,470 | B1 * | 8/2002 | Nakajima et al. | 700/237 |
| 6,508,398 | B1 * | 1/2003 | Estes | 235/379 |
| 6,640,156 | B1 | 10/2003 | Brooks et al. | |
| 7,092,907 | B2 * | 8/2006 | Kanevsky et al. | 705/51 |
| 7,395,241 | B1 * | 7/2008 | Cook et al. | 705/39 |
| 7,404,515 | B1 * | 7/2008 | Shepley et al. | 235/379 |
| 2001/0051884 | A1 * | 12/2001 | Wallis et al. | 705/4 |
| 2002/0035541 | A1 * | 3/2002 | Makino et al. | 705/43 |
| 2002/0046061 | A1 * | 4/2002 | Wright et al. | 705/3 |
| 2002/0091972 | A1 * | 7/2002 | Harris et al. | 714/47 |
| 2003/0023325 | A1 * | 1/2003 | Adachi et al. | 700/9 |
| 2004/0164141 | A1 * | 8/2004 | Egami et al. | 235/379 |
| 2008/0027659 | A1 * | 1/2008 | Miyasaka et al. | 702/39 |
| 2008/0220707 | A1 * | 9/2008 | Jones et al. | 453/2 |
| 2008/0243915 | A1 * | 10/2008 | Shah et al. | 707/103 Y |

FOREIGN PATENT DOCUMENTS

| | | |
|---|---|---|
| DE | 10 107 344 | 10/2001 |
| EP | 1 396 821 | 3/2004 |
| FR | 2 841 024 | 12/2003 |
| JP | 2001093025 | 4/2001 |
| JP | 2003303367 | 10/2003 |

(Continued)

*Primary Examiner* — Mark Beauchaine
(74) *Attorney, Agent, or Firm* — Bacon & Thomas, PLLC

(57) ABSTRACT

A system of banknote processing machines, a banknote processing machine and a method for operating same are provided wherein data necessary for operation of the banknote processing machines are exchanged between the banknote processing machines and a service center.

77 Claims, 2 Drawing Sheets

FOREIGN PATENT DOCUMENTS

| | | |
|---|---|---|
| WO | 99/23601 | 5/1999 |
| WO | 00/05688 | 2/2000 |
| WO | 01/18754 | 3/2001 |

* cited by examiner

SYSTEM CONSISTING OF BANK NOTE PROCESSING MACHINES, BANK NOTE PROCESSING MACHINE AND ASSOCIATED OPERATING METHOD

BACKGROUND OF THE INVENTION

A. Field

The invention relates to a system of banknote processing machines, to a banknote processing machine and to a method for operating same.

B. Related Art

Banknote processing machines are used to check banknotes with regard to their properties, such as authenticity, condition, type of banknote, etc. Depending on the result of the check, the banknotes may be accepted, sorted, stored, destroyed, etc. For operation of the banknote processing machines, it is necessary to perform a plurality of adjustments, to update data, etc., in order that the desired processing operations can be carried out using the banknote processing machine. Such adjustments and data are carried out and provided either at the time of manufacture of the banknote processing machine or by service personnel who make the appropriate adjustments and provide appropriate data at the site of the banknote processing machine when alterations are required.

However, it has been found that the outlay required in making such adjustments and in providing up-to-date data is very high since, for each adjustment and each provision of up-to-date data, a service person must travel to the site of the banknote processing machine. Similar problems arise in the event of faults or malfunctions of the banknote processing machines. In this case, too, a service person must travel to the banknote processing machine in order to remove the faults or malfunctions.

SUMMARY OF THE INVENTION

The object of the present invention is to provide a system of banknote processing machines, a banknote processing machine and a method for operating same, in which the outlay in terms of operating the banknote processing machines can be considerably reduced.

This object is achieved according to the invention by a system of banknote processing machines, a banknote processing machine and a method for operating same, which have features described herein.

In the system of banknote processing machines according to the invention, the banknote processing machine according to the invention and the method according to the invention for operating same, data necessary for operation of the banknote processing machines are exchanged between the banknote processing machines and a service centre.

By virtue of the exchange of data, a plurality of adjustments necessary for operation can be made from the service centre without a service person having to locate the site of the banknote processing machine. In addition, faults or malfunctions of the banknote processing machines can be removed from the service centre if the data produced in the banknote processing machines during operation are analysed in order to draw conclusions therefrom concerning the faults or malfunctions.

Further advantages of the present invention will emerge from the dependent claims and from the following description of embodiments, which are given with reference to figures.

DETAILED DESCRIPTION OF PREFERRED EMBODIMENTS OF THE INVENTION

Structure Of The System

Figure 1:
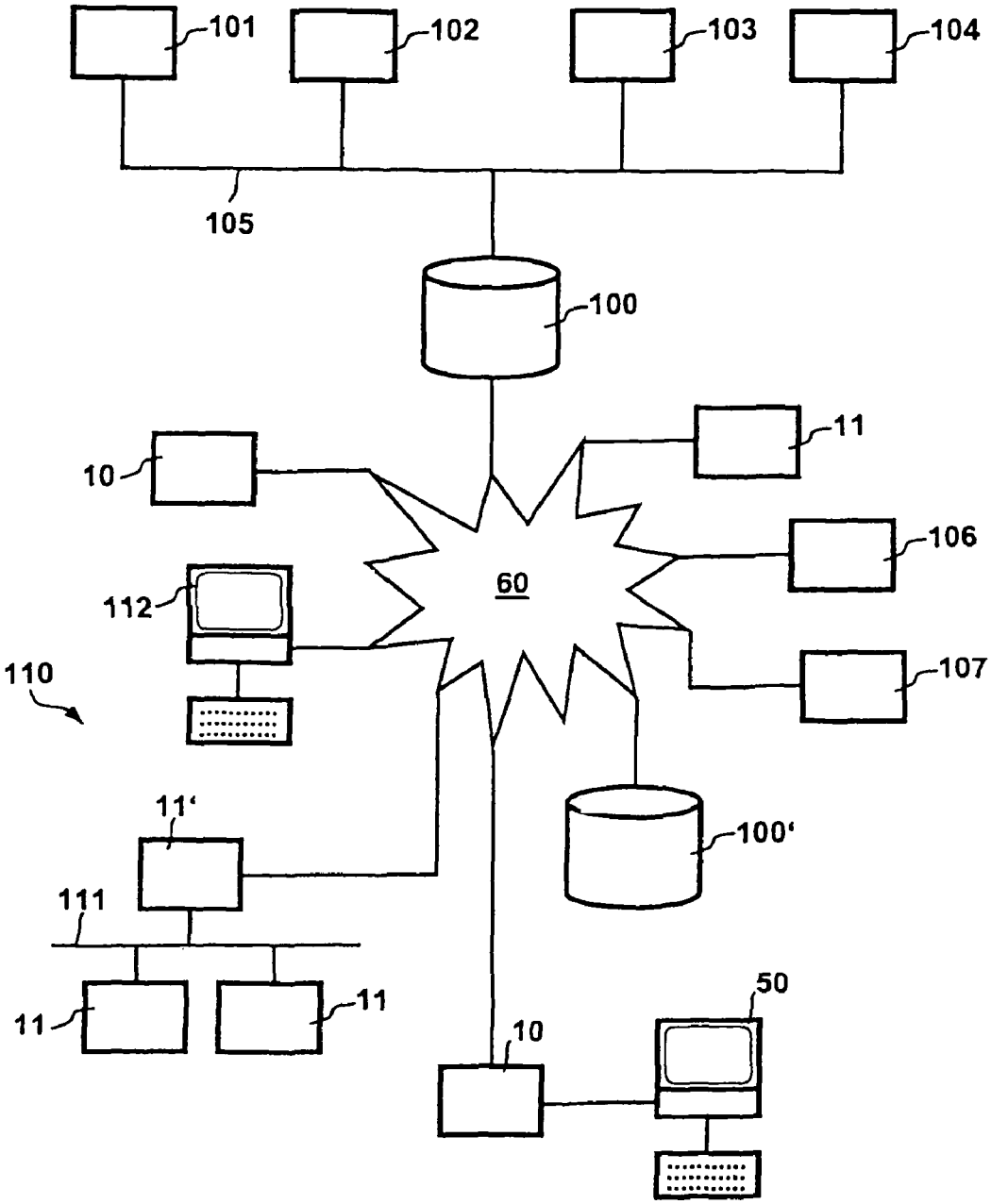
FIG. 1 shows a fundamental structure of one embodiment of a system of banknote processing machines.

FIG. 1 shows a fundamental structure of one embodiment of a system of banknote processing machines with a service centre.

The system may consist of one or more banknote processing machines 10, 11, the structure of which will be described in more detail below. Via a network 60, for example, a wired and/or wireless telephone network, a local network, the Internet, etc., the banknote processing machines 10, 11 are connected to a service centre 100, which consists, for example, of a data memory or database, that is to say a computer with a storage medium. The network 60 may also be embodied in some other way, for example, as a wireless network or as a network, which supplies data via the power supply network.

Structure of Banknote Processing Machines

Figure 2:
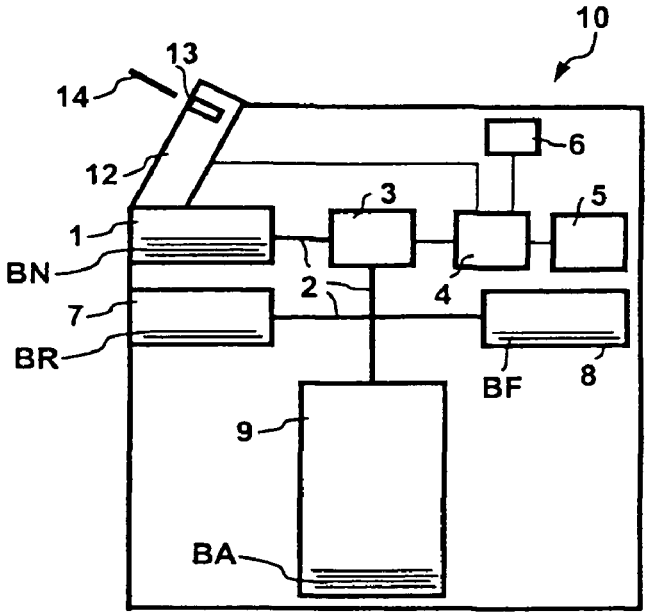
FIG. 2 shows a schematic view of a fundamental structure of a first embodiment of a banknote processing machine, which is suitable for the paying-in and acceptance of banknotes.

FIG. 2 shows a schematic view of a fundamental structure of a first embodiment of a banknote processing machine 10, which is suitable for the paying-in and acceptance of banknotes and may be designed as an automatic teller terminal. However, the banknote processing machine 10 may also form part of a vending machine.

The automatic teller terminal 10 has an input compartment 1, into which banknotes BN that are to be paid in are placed by a paying-in person or customer or by an operating person. The banknotes BN are removed from the input compartment 1 by a transport system 2 and are fed to a sensor device 3. In the sensor device 3, features of each individual banknote are detected, these features being relevant, for example, in assessing the authenticity, the type (currency, denomination), the condition, etc. of the banknote. Such features may be detected mechanically, acoustically, optically, electrically and/or magnetically, for example, by various sensors. Known authenticity features include, for example, printing inks having special optical and/or magnetic properties, metallic or magnetic security threads, the use of brightener-free banknote paper, information contained in an electrical circuit, etc. The type of banknote is defined, for example, by its size, its printing pattern, colours, etc., whereas the condition of the banknote can be derived, for example, from the optical appearance (soiling). The features are detected by the sensor device 3 and corresponding data are transmitted from the sensor device 3 to a control device 4.

The control device 4 compares the data concerning the detected features with comparison data, which make it possible to recognize authentic banknotes and counterfeit or suspect banknotes, the type of banknote, the condition of the banknotes, etc. The comparison data and programs necessary for operation of the automatic teller terminal 10 are in the form of software and are stored in the control device 4 or in a non-volatile memory 5 assigned to the control device 4. The non-volatile memory 5 may be formed, for example, by an EEPROM or a Flash memory, a hard disk, etc. Furthermore, a random access memory (not shown) may be connected to the control device 4, said random access memory being used by the control device 4 to run the software.

Based on the check of the respective banknote, which is carried out by the control device 4, sorting gates (not shown), which are arranged in the transport system 2 are activated in order, for example, to place counterfeit or suspect banknotes BF in a storage compartment 8, whereas banknotes BA, which are classed as authentic can be stored in a further compartment 9, for example, a cassette. Banknotes BR, which are not recognized or which cannot be processed for other reasons, for example, because the paying-in person terminates the paying-in process, are transported to and placed in a return compartment 7.

For control of the automatic teller terminal 10 by the customer or paying-in person, an input/output device 12 is connected to the control device 4 in order, for example, to be able to select certain processing modes or to inform the paying-in person about the processing of the banknotes paid in. The input/output device 12 usually has a keyboard and a display, but may also have a touch-sensitive display (touch screen) or any combination of the aforementioned means. The input/output device 12 may additionally have a printer. The input/output device may moreover have an identification device 13, for example, a reader for a chip card or magnetic strip card 14. By inputting his individual card 14, the paying-in person can identify himself to the automatic teller terminal 10 and can ensure that the amount corresponding to the banknotes paid in is correctly assigned to his account.

Via an interface 6, which is provided in the automatic teller terminal 10 and is connected to the control device 4 or the non-volatile memory 5, stored software and/or the comparison data and/or other data can be fully or partially replaced and/or supplemented by additional components and/or exchanged via the network 60 shown in FIG. 1, for example, with the service centre 100, or else communication can be carried out. The interface 6 may be configured, for example, as a modem, a network connection, an Internet connection, etc.

Figure 3:
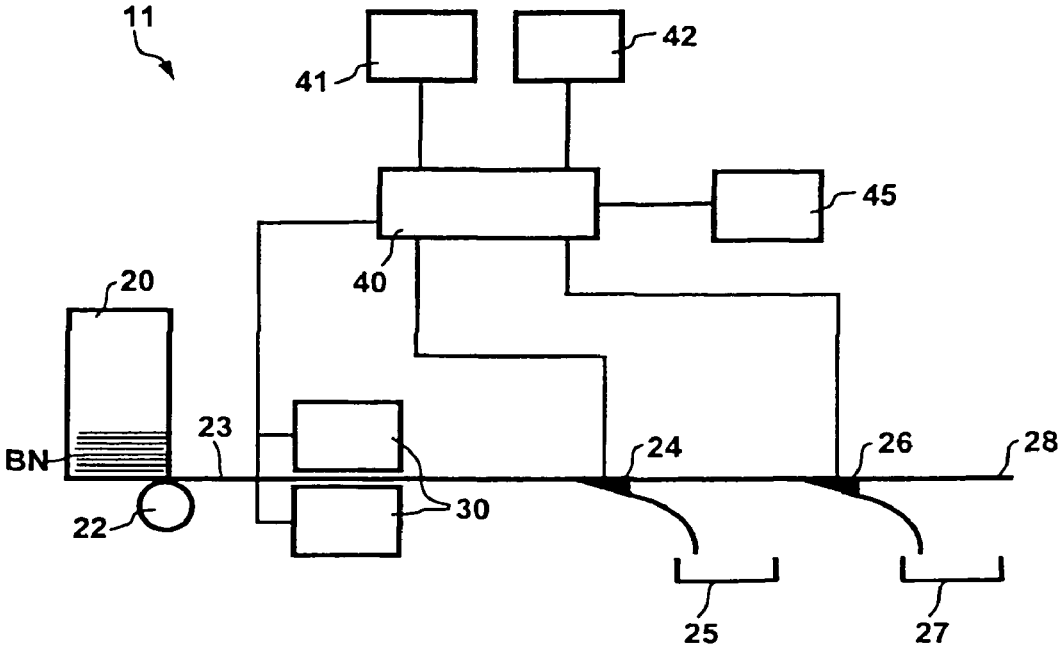
FIG. 3 shows a schematic view of a fundamental structure of a second embodiment of a banknote processing machine, which is suitable for checking and sorting banknotes.

FIG. 3 shows a schematic view of a fundamental structure of a second embodiment of a banknote processing machine 11, which is suitable for checking and sorting banknotes.

The banknote processing machine 11 has an input compartment 20 for inputting banknotes BN to be processed, in which a separator 22 engages. The separator 22 in each case grips one of the banknotes BN to be processed and transfers the individual banknote to a transport system 23, which transports the individual banknote through a sensor device 30. In the sensor device 30, features of each individual banknote are detected, these being relevant, for example, in assessing the authenticity, the type (currency, denomination), the condition, etc. of the banknote. Such features may be detected, for example, mechanically, acoustically, optically, electrically and/or magnetically. Known authenticity features include, for example, printing inks having special optical and/or magnetic properties, metallic or magnetic security threads, the use of brightener-free banknote paper, information contained in an electrical circuit, etc. The type of banknote is defined, for example, by its size, its printing pattern, colours, etc., whereas the condition of the banknote can be derived, for example, from the optical appearance (soiling). The features are detected by the sensor device 30 and corresponding data are transmitted from the sensor device 30 to a control device 40.

The control device 40 compares the data concerning the detected features with comparison data, which make it possible to recognize authentic banknotes and counterfeit and/or suspect banknotes, the type of banknote, the condition of the banknotes, etc. The comparison data and programs necessary for operation of the banknote processing machine 11 are available in the form of software and are stored in the control device 40 or in a non-volatile memory 41 assigned to the control device 40. The non-volatile memory 41 may be formed, for example, by an EEPROM or a flash memory or a hard disk. Furthermore, a random access memory (not shown) may be connected to the control device 40, said random access memory being used by the control device 40 to run the software.

Based on the check of the respective banknote, which is carried out by the control device 40, sorting gates 24, 26, which are arranged in the transport system 23 are activated in order, for example, to place counterfeit or suspect banknotes in one output compartment 25, whereas banknotes, which are classed as authentic can be stored in a different output compartment 27. The transport system 23 may also be extended so that the banknotes can be fed to a further processing operation 28, for example, further output compartments, a safe or cassettes in which the banknotes can be securely stored and transported, a shredder, etc.

For control of the banknote processing machine 11 by an operating person, an input/output device 45 is connected to the control device 40 in order, for example, to be able to select certain processing modes or to inform the operating person about the processing of the banknotes BN. To this end, a keyboard and a display may be provided. It is also possible for use to be made of a touch-sensitive display (touch screen) or of any combination of the aforementioned means. A printer may also be provided, in order, for example, to be able to print out accounting data in respect of banknotes, which have been processed by the banknote processing machine 11. The input/output device 45 may furthermore have a card reader, which is suitable for reading cards with magnetic strips and/or chips. Such cards may be used, for example, to identify the operating person to the banknote processing machine 11, in order, for example, to specify a specific account to which the total sum of the banknotes to be processed is to be assigned. It may also be provided that the operating person has to input a secret password in order to be able to perform the identification.

An interface 42 is also provided, which makes it possible, via the network 60 shown in FIG. 1, to communicate with the control device 40 and to fully or partially replace the software stored in the non-volatile memory 41 and/or the comparison data and/or other data and/or to supplement it by additional components and/or to read it via the interface 42. To this end, the interface 42 may be configured, for example, as a modem, a network connection, an Internet connection, etc.

In another modification to the described embodiments of the banknote processing machines 10, 11, it may be provided that the control device 4, 40, the non-volatile memory 5, 41, the sensor device 3, 30, etc. are not connected to one another directly as shown, but rather via one or more data buses.

In another modification, a separate control device and/or a separate non-volatile memory may be provided for the sensor device 3, 30, which checks the banknotes and forwards the result of the banknote check to the control device 4, 40 so that the latter can control the banknote processing machine 10, 11 in the manner described above. In this case, it may be provided that software and/or data are provided and loaded separately for the control device 4, 40 and the separate control device of the sensor device 3, 30. The software and/or data may also be provided and loaded for both control devices together.

It is also obvious that the banknotes BN are transported by the transport system 2, 23 along their long or short edges during processing in the banknote processing machines 10, 11. Suitable comparison data must be provided, for example, depending on the configuration of the transport system 2, 23, since the comparison data depend on the transport direction of the banknotes.

Structure of the System of Banknote Processing Machines

The system (shown in FIG. 1) consisting of banknote processing machines 10, 11, network 60 and service centre 100 may comprise a plurality of the above-described banknote processing machines 10, 11 and also other banknote processing machines. Certain components of the banknote processing machines 10, 11 may also be connected directly to the service centre 100, for example, the sensor device 3, 30 with the dedicated control device.

EXAMPLE 1

As shown by way of example for a banknote processing machine 10, the banknote processing machine 10 may be connected to a computer 50, which is used by an operating person or service person to start and/or control the processes taking place between the banknote processing machine 10 and the service centre 100. It is also possible for there not to be a computer 50, and for the input/output device 12 to be used by the service person. In this case, it may be provided that the service person identifies himself by means of a special card 14. If the computer 50 is used, the connection to the network 60 may be established by means of an interface of the computer 50, for example, a wireless connection via GSM or UMTS. In this case, the interface 6 of the banknote processing machine 10 can be omitted.

EXAMPLE 2

The banknote processing machines 10, 11 may be individually connected via the network 60 to the service centre 100. However, it is also possible for a number of banknote processing machines 11, which are connected to one another directly or via a data bus or a local network 111 to be connected to the service centre 100 via one banknote processing machine 11' and the network 60. The banknote processing machine 11', which is connected to the network 60 in this case performs the data exchange or communication with the service centre 100. The data and/or software originating from the service centre 100 are made available to the other banknote processing machines 11 via the local network 111. In the same way, data and/or software originating from the other banknote processing machines 11 are transmitted via the local network 111 to the banknote processing machine 11', in order that the latter can forward this data and/or software to the service centre 100. If the banknote processing machines 11 are directly connected to one another, a cascade-type connection may be provided. As a result, particularly fast transmission of the data and/or software is possible, since transmission can take place in an avalanche-type manner in the cascade. The local network 111 may also be formed as a wireless network or as a network, which supplies data via the power supply network.

The banknote processing machines 11, 11' may be assigned to a certain operator 110, for example, to a certain bank, a security transport company, etc. In order to monitor the individual banknote processing machines 11, 11', the operator 110 may have a monitoring unit 112, for example, a computer. The computer 112 is connected to the network 60 and the service centre 100 via a suitable interface. As a result, the operator 110 can also use the computer 112 to bring about an exchange of data and/or software between the service centre 100 and the banknote processing machines 11', 11. It is also possible for the computer 112 to be connected directly to the local network 111 or to individual banknote processing machines 11, 11'.

It is obvious that an operator 110 can operate various banknote processing machines 10, 11, which are connected to the service centre 100 in the described manner via a single banknote processing machine 11' and the network 60. The individual banknote processing machines 10, 11 of the operator 110 may also be connected to the service centre 100 directly via the network 60. It is also possible for the local network 111 to be connected to the network 60 via a suitable interface.

Service Centre

In the service centre 100, the data and requests from banknote processing machines 10, 11 and from operators 110 are collected and evaluated. Actions, such as the transmission of software, for example, can be started by the service centre 100.

A number of stations or departments 101 to 104 can access the data and/or software of the service centre 100 via a suitable connection 105, for example, a local network, or the stations 101 to 104 provide the data and/or software. Instead of via the local network 105, the departments 101 to 104 may also be connected to the service centre 100 via the network 60.

EXAMPLE 3

The station 101 may, for example, be a development department 101 of the manufacturer of the banknote processing machines 10, 11, which, for example, develops and produces software for operation of the banknote processing machines 10, 11 in order to transmit it to the data memory of the service centre 100.

EXAMPLE 4

Furthermore, a department 102 for adapting comparison data may be connected to the service centre 100 via the local network 105. In the department 102 for adapting comparison data, comparison data for banknotes BN to be processed by the banknote processing machines 10, 11 are produced and are stored in the data memory of the service centre 100. To this end, banknotes of different currencies to be processed are examined and suitable comparison data are produced for each denomination of each currency. Any counterfeits currently appearing can also be taken into account in this process.

EXAMPLE 5

An expert department 103 may also be provided, which supplies data and/or software to the service centre 100, which are required for repairing and/or servicing the banknote processing machines 10, 11.

EXAMPLE 6

A sales and marketing department 104 may additionally be provided, which supplies general information for customers, future customers or the operators of the banknote processing machines 10, 11. By way of example, the sales and marketing department 104 may supply pricing details to the service centre 100, which may include prices for data and/or software and/or certain services.

It is obvious that the individual departments 101 to 104 can supply their respective data to one another and that the individual departments 101 to 104 can access the data of the respective other departments 101 to 104 in the data memory of the service centre 100.

It is also obvious that the individual departments 101 to 104 can also evaluate the data, which originate from the banknote processing machines 10, 11 and are stored in the service centre 100, in order to perform their respective tasks, for example, the development of new software when faults occur or the creation of invoices when software is transmitted to individual banknote processing machines 10, 11. If other data from the banknote processing machines 10, 11, which are not available in the data memory of the service centre 100 should be required for this, the corresponding data can be called up from the respective banknote processing machines 10, 11 by the departments 101 to 104 via the service centre 100 and the network 60.

EXAMPLE 7

In order to relieve the load on the service centre 100, it may be provided that further service centres 100', or at least data memories, are connected to the network 60. The further service centres 100' may be located, for example, in different countries, in order to distribute and thus reduce the load on the service centre 100 due to enquiries from banknote processing machines 10, 11. As a result, faster processing of the enquiries is possible. Additionally, in the respective countries, it is possible, for example, for communication in the respective language to be offered, as a result of which simplification is achieved. Usually, the further service centres 100' are formed by data memories, which correspond to the data memory of the service centre 100. The data and/or software of the data memory of the service centre 100 will then transmit to the further service centres 100' at certain points in time, in order to update the data and/or software contained therein.

EXAMPLE 8

Via the network 60, a service organization 106 or service personnel can access the data and/or software of the service centre 100, for example, by means of the above-described computer 50. In this case, it may be provided that the service organization 106 performs tasks and functions, which correspond to those of the service centre 100 or further service centres 100', that is to say the service organizations 106 have in particular a data memory, which corresponds to the data memory of the service centre 100.

EXAMPLE 9

Moreover, potential new operators 107, or customers, can access the data and/or software of the service centre 100 in order, for example, to inform themselves about the banknote processing machines 10, 11 currently offered by the manufacturer.

Within the described system, it is thus possible to provide new software, data, comparison data, etc. by using the service centre 100. This software, data, comparison data, etc. can also be provided as a trial version, that is to say they are valid only for a certain time or for a certain number of uses.

It is also possible for offers to be sent to the operators 110 or potential operators 107 of the banknote processing machines 10, 11 via the system. For service personnel, the operators 110 or potential operators 107 it is possible, for example, by means of search functions, to obtain an overview of what is currently offered, e.g. new versions of software, etc.

An operator can also establish a connection to the service centre 100 if special services or assistance is/are required. Corresponding services or assistance can be offered by the service centre 100 or the above-described departments 101 to 104, and can be provided via the network 60. In particular, it may also be provided that acoustic and/or optical instructions are provided by the service centre 100 or by one or more of the departments 101 to 104. To this end, in addition to the display, a loudspeaker may also be contained, for example, in the banknote processing machine 10, 11. It is also possible to provide the acoustic and/or optical information on the computer 50, 112 or on another mobile unit, for example, a mobile telephone with picture display.

Moreover, the service centre 100 can inform the service organization 106 or a service person directly that certain services have to be carried out on a certain banknote processing machine 10, 11. For preparation of the services by the service organization 106 or the service person, information may also be provided with regard to which particular replacement parts and/or spare parts are required, so that the service person can take these with him to the banknote processing machine 10, 11. It is also possible for the service centre 100 to trigger the dispatch of the required replacement parts and/or spare parts to the service organization 106 or to the site of the banknote processing machine 10, 11. In some cases, exchange of the replacement parts and/or spare parts can then be carried out by the operator or the operating person of the banknote processing machine 10, 11. In other cases, the visit by the service person is controlled by the service centre 100 or the service organization 106 in such a way that the service person visits the banknote processing machine 10, 11 only once the necessary replacement parts and/or spare parts are available.

Data Transmission

Advantageously, a standard protocol is used as the communication protocol for communication or for data exchange between the service centre 100, the banknote processing machines 10, 11, the service organization 106, etc.

EXAMPLE 10

If, for example, HTTP is used by the service centre and the banknote processing machines 10, 11, no additional software is required for communication or for evaluation of the data received from the banknote processing machines 10, 11. Additionally, secure transmission is possible if the HTTPS protocol is used.

EXAMPLE 11

It is also possible to use the TCP/IP protocol for communication. In this case, a connection can be set up between the service centre 100 and the respective banknote processing machine 10, 11 via the standard port (port 21). The port used for communication, that is to say the port via which the data exchange is to take place, is then negotiated in a dynamic fashion, for example, for each connection set-up and/or after expiry of a certain time. This makes unauthorized listening and "hacking" much more difficult.

EXAMPLE 12

From the service centre 100, it is possible to request a wide range of data and information concerning the status of the banknote processing machines 10, 11. The status of the banknote processing machine 10, 11 can also be adjusted or changed. By way of example, the status of the banknote processing machine 10, 11 can be requested and displayed and/or processed in the service centre 100. So-called master data, such as information about serial numbers of the banknote processing machine 10, 11 or of individual components, e.g. the sensor device 3, 30, the version of the software stored in the non-volatile memory 5, 41 of the banknote processing machine 10, 11, the status of the banknote processing machine 10, 11, e.g. the filling level in the output compartments 25, 27 or in the cassettes, which receive the banknotes, fault status or readiness for operation, etc. can be requested and displayed.

EXAMPLE 13

Information about the sensor device 3, 30 and its individual sensors can also be requested, and the status thereof can be displayed.

EXAMPLE 14

Another possibility is the activation of actuators of the banknote processing machine 10, 11, for example, to enquire about the status of light barriers arranged in the transport path 2, 23, or to activate magnets, which operate the sorting gates 24, 26 for example.

EXAMPLE 15

The requesting and display of log files and/or statistics concerning the banknote processing machines 10, 11 by the service centre 100 is particularly advantageous. These are data, which are collected in special files and which are produced during operation of the banknote processing machine 10, 11 and are stored in the non-volatile memory 5, 41, for example, under the control of the control unit 4, 40. By evaluation of these data in the service centre 100, conclusions can be drawn, for example, about faults, which have occurred during operation of the banknote processing machine 10, 11.

EXAMPLE 16

The files containing the information can be evaluated with particular ease in the service centre 100 if the files are generated and transmitted in a universal format, for example, the XML format. By virtue of the universal format, visualization and evaluation, or post-processing such as transfer to another database, for example, is possible in a very simple manner, for example, using an Internet browser. Evaluation or post-processing, such as transfer to another database, for example, can be achieved in a very simple manner, for example, by means of a standard parser.

EXAMPLE 17

Another advantageous use of the connection of the banknote processing machines 10, 11 to the service centre via the network 60 is the calling-up of software or data by the banknote processing machine 10, 11. To this end, a new version of a certain item of software or an item of software that has until now been unavailable, e.g. for a particular mode of operation, can be called up by the banknote processing machine 10, 11 from the service centre 100. The corresponding item of software is then transmitted to the respective banknote processing machine 10, 11 and stored in the non-volatile memory 5, 41 thereof. In the case where the software is subject to a fee, the respective banknote processing machine 10, 11 can be identified, for example, on the basis of its serial number, so that the fees can be charged accordingly.

EXAMPLE 18

For operation of the banknote processing machines 10, 11, usually a plurality of presets of various parameters are required, which are necessary for operation under the respective, individual conditions of use of the banknote processing machine 10, 11. This presetting of the parameters can be configured by means of the service centre 100 and a file containing the presets can be generated and transmitted to the respective banknote processing machine 10, 11 via the network 60. It is particularly advantageous to generate the file containing the presets in a universal format, for example, the XML format, since evaluation programs, for example, the aforementioned standard parser, are available and can be used to evaluate the file in the XML format. In the banknote processing machine 10, 11, it is ensured that the new file containing the altered presets is detected automatically and the altered presets become effective immediately. This may be achieved, for example, by the control device 4, 40 checking a version number and/or a creation date of the file containing the presets.

EXAMPLE 19

One of the abovementioned presets may be, for example, a language, which is to be used for operation of the banknote processing machine 10, 11. To this end, the banknote processing machine 10, 11 may be designed to be multilingual. Appropriate languages can be stored in the non-volatile memory 5, 41 and can be selected on the basis of the preset. However, the data for the respective language can also be loaded via the network 60 from the service centre 100. The selected language is then used both for the display and the printer of the input/output device 12, 45. Commands, which are input via the keyboard are also expected in the selected language. Besides selecting the language via the presets, the language can also be selected directly via the service centre 100. Another possibility is to configure the selection of the language depending on the respective user of the banknote processing machine 10, 11. When the operating person identifies himself to the banknote processing machine 10, 11 by means of the above-described card 14, the language can be selected on the basis of a corresponding information item on the card 14. It is also possible for a profile for the respective user to be stored in the non-volatile memory 5, 41, which profile also contains an information item concerning the language, which is to be selected. If a profile for the respective user in the non-volatile memory is used, the user may also identify himself by inputting his name or his account number and possibly a secret password. To this end, use may be made of the keyboard or the touch-sensitive display of the input/output device 12, 45.

EXAMPLE 20

Presets, such as the abovementioned language, for example, can also be set depending on the site of the banknote processing machine 10, 11. This may be achieved automatically by the site being determined by the banknote processing machine 10, 11. To this end, a satellite navigation device according to the GPS or Galileo standard may be used. By determining the site, it is possible to determine the country and the language, which is to be used for operation of the banknote processing machine 10, 11. Furthermore, the comparison data for the currency of the country may, for example, automatically be used to check the banknotes to be processed.

Dealing with Faults

The occurrence of faults is of particular importance in terms of operation of the banknote processing machines 10, 11. In order to remove any faults that have occurred as quickly as possible, it is provided that, for each fault, which may occur, a suitable reaction is proposed, which is suitable for removing the fault. For this, use is made of the display of the input/output device 12, 45.

EXAMPLE 21

In order to be able to react in a flexible manner to a wide range of faults, different images or diagrams are generated and displayed depending on the fault, these corresponding, for example, to the structure of the banknote processing machine 10, 11 shown schematically in FIGS. 2 and 3. The location presenting the fault is then displayed in some special way, for example, by flashing of the transport system 23 in the section between the sorting gates 24 and 26 after a jam has been found in this section. In addition or as an alternative, a text can be displayed, which contains instructions, which are helpful for removing the fault that has occurred. The corresponding images, diagrams and texts can be stored in the non-volatile memory 5, 41 of the banknote processing machine 10, 11 and are selected by the control device 4, 40 after the latter has detected a corresponding fault, for example, the jam mentioned above.

EXAMPLE 22

In the case where the above-described touch-sensitive display is used, special operating elements may be generated and displayed by means of the touch-sensitive display so that the user can start special mode of operations in order to remove the fault that has occurred. By way of example, in the above-described case of the jam, a special transport mode may be started, e.g. a very low transport speed, for the transport system 23, in order to convey the banknotes, which are causing the jam out of the transport system 23.

EXAMPLE 23

It may also be provided that, when a fault occurs, forced management by the control device 4, 40 is defined and is displayed by the display of the input/output device 12, 45. In this case, instructions in image and/or text form are shown on the display in a predefined order, said instructions being suitable for removing the fault that has occurred.

EXAMPLE 24

It may also be provided that it is necessary for a number of persons to be involved in removing a fault. To this end, the appropriate persons are indicated on the display of the input/output device 12, 45, for example, an employee of a bank and a service person. The appropriate persons can then identify themselves to the banknote processing machine 11, for example, as described above, by means of their individual card 14 or their name and password. Only when all the necessary persons are present can the fault be removed. Such a measure may be necessary, for example, when an unknown quantity of banknotes is involved in the abovementioned jam. The employee of the bank can then monitor the work carried out by the service person.

EXAMPLE 25

If the fault, which has occurred cannot readily be removed, it may also be provided that the service centre 100 is connected in via the network 60. For this, after a corresponding fault has been detected, the control device 4, 40 of the banknote processing machine 10, 11 sets up a connection to the service centre 100 via the interface 6, 42 and the network 60. The connection may also be set up by an operating person of the banknote processing machine 10, 11 by means of the input/output device 12, 45. The service centre 100 then triggers all the other steps, which are necessary in order to remove the fault. By way of example, special instructions may be given to the user of the banknote processing machine 10, 11 via the display of the input/output device 12, 45. It is also possible for the service centre 100, as described above, to request and analyse data concerning the operation of the banknote processing machine 10, 11, in order to initiate measures to remove the fault. The service centre 100 may also trigger the sending of a service person to the site of the banknote processing machine 10, 11 in order to remove the fault. In this case, the analysed data may be made available to the service person as a basis, for example, it may be obvious from said data that particular replacement parts are required in order to remove the fault, and the service person can then take these replacement parts with him.

EXAMPLE 26

Instead of the service centre 100 requesting the above-described data from the banknote processing machine 10, 11, it is in general also possible for the banknote processing machine 10, 11 to send the data automatically to the service centre 100 without any request being made, for example, at certain times. As described above, the data from the banknote processing machine 10, 11 are analysed by the service centre 100, and, as a reaction, a corresponding reply is sent to the banknote processing machine 10, 11. In addition, the banknote processing machine 10, 11 may send an enquiry to the service centre 100 as to whether new data and/or software are available. Such new data and/or software can then be sent by the service centre 100 to the banknote processing machine 10, 11.

Distribution of Software

For the distribution of software, data, comparison data, etc. from the service centre 100 to the banknote processing machines 10, 11 connected via the network 60, many procedures are possible, which will be described below on the basis of examples. For the sake of simplification, only software will be dealt with here, but it goes without saying that it also encompasses the distribution of data, comparison data, parameters, presets, etc.

By virtue of the distribution of software over the system consisting of service centre 100, network 60 and banknote processing machines 10, 11, the situation can be achieved whereby new software is made available to the banknote processing machines 10, 11 particularly rapidly, even when the latter are arranged over a large number of locations, even worldwide. Furthermore, this is possible with very little use of service personnel, since distribution over the system takes place largely automatically. It can thus be ensured that the most recent software is always available, as a result of which faults contained in the software can be removed at any time, quickly and with little outlay.

EXAMPLE 27

A distribution of software can be triggered by the respective banknote processing machine 10, 11. To this end, the control device 4, 40 of the banknote processing machine 10, 11 checks via the interface 5, 42 and the network 60 whether new software is available in the service centre 100. To do this, the control device 4, 40, via the interface 5, 42 and the network, sets up a connection to the service centre 100 if no connection exists. The control unit 4, 40 sends identification data from the respective banknote processing machine 10, 11, for example, the type, serial number, etc., and also a version number of the software stored in the non-volatile memory 5, 41 to the service centre 100. Based on the identification data, the latter ascertains whether new software is available for the respective banknote processing machine 10, 11. To this end, the version number of the software of the respective banknote processing machine 10, 11 is compared with the version number of the most up-to-date software for the type of respective banknote processing machine 10, 11. If a more recent version exists, the corresponding software is sent by the service centre 100 to the banknote processing machine 10, 11.

The connection may optionally also be set up to the above-described additional service centre 100' or to the service organization 106. During set-up of the connection, the service centre 100 or 100' or service organization 106 can check whether the respective banknote processing machine 10, 11 is authorized to obtain software. This may be effected by checking the identification data. A password may additionally be requested from the respective banknote processing machine 10, 11. In order to make the data transfer secure, use may be made of the above-described secure or encrypted connections.

The check for availability of new software by the respective banknote processing machine 10, 11 may, for example, be initiated in a cyclic fashion, for example, the control device 4, 40 may carry out the above-described procedure once per week, preferably at a time where experience has shown that the banknote processing machine 10, 11 is not being used. The point of time may be predefined in a fixed manner, for example, always on Sundays at 4:00 am. However, the control device 4, 40 may also document the time periods during which the machine is being used and is not being used, and based on this information can check for the availability of new software when usually no use is to be expected. The availability of new software can also be checked depending on certain events, for example, when the banknote processing machine 10, 11 is switched off by the operating person. In this case, the banknote processing machine 10, 11 switches off automatically once the check has been carried out and any software has been loaded.

When the banknote processing machine 10, 11 sends an enquiry with regard to new software, a targeted check may be carried out to ascertain whether certain software components are available. By way of example, a targeted check can be carried out to ascertain whether new comparison data are available, during the production of which any new types of counterfeit have been taken into account.

EXAMPLE 28

A distribution of software can be triggered by the service centre 100. To this end, the service centre 100, via the network 60, sets up a connection to the respective banknote processing machine 10, 11 or to a number of banknote processing machines 10, 11. The respective banknote processing machine 10, 11 checks whether the authorized service centre 100 actually intended to set up the connection; this may be carried out, for example, by an identification of the service centre 100 and/or a password. In addition, as described above, the connection may be set up as a secure and/or encrypted connection. The connection may optionally also be set up by the above-described additional service centre 100' or by the service organization 106.

The connection may always be set up at certain, predefined points in time. Optionally, the connection may also be set up when particular events take place, for example, when a new software version for a certain type of banknote processing machine 10, 11 is available in the data memory of the service centre 100.

Once the connection has been set up, the respective banknote processing machine 10, 11 will firstly transmit at least its identification data, that is to say its type, a serial number, version numbers of the software, etc. so that the service centre 100 can check and/or update the data stored in its data memory with regard to the respective banknote processing machine 10, 11. Based on the identification data, the new software will be transmitted by the service centre 100 to the respective banknote processing machine 10, 11. The respective banknote processing machine 10, 11 stores the transmitted software in the non-volatile memory 5, 41.

However, it is possible for the respective banknote processing machine 10, 11 to deny the storage of the new software or even the setting-up of the connection to the service centre 100. This may be the case, for example, if the respective banknote processing machine 10, 11 is not ready at present, for example, because banknotes BN are being processed. Another reason may be the fact that the respective banknote processing machine 10, 11 is excluded from the software update because it is a trial device. In the aforementioned cases, it may however be provided that the service centre 100 sends a special password to the respective banknote processing machine 10, 11, which overrules the denial of the connection set-up or of the storage of new software.

The above-described procedure for the distribution of software by the service centre 100 may be performed by the service centre 100 for all the banknote processing machines 10, 11, which are known to the service centre 100, that is to say the identification data of which are stored in the data memory of the service centre 100. When banknote processing machines 10, 11 are brought into operation for the first time, the identification data thereof must accordingly be recorded in the data memory. The same applies in the event of a change in identification data, for example, when the banknote processing machine 10, 11 is brought back into operation at a different site, as a result of which the connection via the network 60 changes and a new address necessary for setting up connections is required. The recording of the identification data in the data memory of the service centre 100 may be effected, for example, in that the identification data are input by a service person directly or via the network 60 into the data memory. However, it may also be provided that the identification data are transmitted by the banknote processing machine 10, 11 newly brought into operation, via the network 60, to the service centre 100, which then stores the identification data in its data memory. In addition, a check may be carried out to ascertain whether the banknote processing machine 10, 11 is authorized to enter its identification data. This may be effected, for example, in that final storage of the identification data in the data memory of the service centre 100 does not take place until the identification data have been checked by the sales and marketing department 104, which has access to all the sales data concerning banknote processing machines 10, 11.

The service centre 100, the service person, the operator or the operating person of the banknote processing machine 10, 11 can also define, which software is made available to the respective banknote processing machine 10, 11 by the service centre 100. By way of example, it may be defined that only new comparison data are provided, which have been produced on the basis of new types of counterfeit.

EXAMPLE 29

Once the connection between the service centre 100 and the banknote processing machine 10, 11 has been set up via the network 60, at the instigation of either the service centre 100 or the banknote processing machine 10, 11 the service centre 100 ascertains, as described above, the banknote processing machines 10, 11 to which software is to be distributed. To this end, the identification data of the banknote processing machine 10, 11 are evaluated by the service centre 100 in order to be able to determine the software required by the respective banknote processing machine 10, 11. For this, account is taken in particular of the type of banknote processing machine 10, 11, the version of the existing software, special wishes of the operator or operating person, a subscription to special types or components of software, etc.

Based on the identification data of the banknote processing machine 10, 11, the service centre 100 selects the software required for the respective banknote processing machine 10, 11 and transmits it via the network 60 to the banknote processing machine 10, 11. It may be provided that the service centre 100 completely prepares the software for the banknote processing machine 10, 11, for example, combines all the necessary comparison data, presets, etc. in addition to the software, so that these can be transmitted as a functional unit to the banknote processing machine 10, 11. This ensures that, even after the software update, for example, the banknote processing machine 10, 11 operates in the manner set beforehand by the operating person. This also prevents compatibility problems, which may arise if, for example, a new version of software is not compatible with existing comparison data or presets.

Once the new software has been transmitted in its entirety from the service centre 100 via the network 60 to the banknote processing machine 10, 11, said software is stored in the non-volatile memory 5, 41. It may also be provided that storage in the non-volatile memory 5, 41 is carried out already during transmission via the network 60.

EXAMPLE 30

In addition, the current software status of the banknote processing machine 10, 11 may be stored in the service centre 100 and/or a computer 50 at the site of the banknote processing machine 10, 11. If the non-volatile memory 5, 41 of the banknote processing machine 10, 11 has sufficient capacity, corresponding storage of the software status may also be carried out in the banknote processing machine 10, 11 itself, or the original software may be retained unaltered. The current software status also contains in particular information about all the individual settings, stored statistics and log files, etc. Based on the stored software status, it is possible to restore the original status of the banknote processing machine 10, 11 if, in the event of faulty transmission or following storage of the new software in the non-volatile memory 5, 41, it is ascertained during a functional check that problems are occurring when running the new software. If the original software have been retained unaltered in the non-volatile memory 5, 41, this can be reused immediately in the event of faulty transmission or installation of the new software.

EXAMPLE 31

Protection of the functionality of the banknote processing machine 10, 11 is additionally improved if fundamental components of the so-called firmware are excluded from changes. Firmware here is understood to mean the parts of the software, which define elementary functions of the control device 4, 40. If such parts of the firmware cannot be changed via the interface 6, 42, the situation can be achieved whereby the banknote processing machine 10, 11 remains functional even if faults occur during the loading of new software and the software is not stored correctly. In this case, the loading operation can be repeated since it is controlled by the unaltered firmware.

Protection of the Software

During the described distribution of software from the service centre 100 via the network 60 to banknote processing machines 10, 11, it is important that only authentic software, that it to say software, which originates from an authorized provider, e.g. the service centre 100, 100' of the manufacturer or from a service organization 106 authorized by the manufacturer, is loaded into the non-volatile memory 5, 41. Otherwise, security problems may arise since it is possible by means of manipulated software to influence the operation of the banknote processing machine 10, 11, as a result of which, for example, accounting operations performed by the banknote processing machines 10, 11 could be influenced in a fraudulent manner.

During the described distribution of software from the service centre 100 via the network 60 to banknote processing machines 10, 11, it is also important that no irregularities arise during the distribution of fee-payable software, that is to say the fee-payable software should be used by the banknote processing machines 10, 11 only once a corresponding fee has been paid.

Authorized Source for Software

The banknote processing machine 10, 11 checks whether the software originates from an authorized source 100, 100', 106, wherein the software is permanently stored in the non-volatile memory 5, 41 of the banknote processing machine 10, 11 only if the software originates from the authorized source 100, 100', 106.

In this way, the situation can be achieved whereby only unaltered software is used for operation of the banknote processing machine 10, 11, as a result of which, for example, manipulations in the processing and accounting of banknotes by altered software can be reliably prevented.

When new software is to be loaded via the interface 6, 42 and stored in the non-volatile memory 5, 41, the control device 4, 40 checks, prior to storage of the software in the non-volatile memory 5, 41, whether the software originates from the authorized source, e.g. the service centre 100, 100' of the manufacturer of the banknote processing machine 10, 11, the service organization 106, etc. To this end, the software is identified by the authorized source, that is to say, for example, the service centre 100, e.g. by forming a hash value for the software or for components of the software. Moreover, the software and/or the hash value may be encrypted, in particular using an asymmetrical encryption method, that is to say the authorized source uses a secret key for the encryption.

By checking the authenticity of the software to be loaded, manipulation of the banknote processing machine 10, 11 by means of altered software can be prevented.

During the loading of software via the interface 6, 42, the control device 4, 40 checks whether the software originates from an authorized source. This may be effected, for example, in that the control device 4, 40 forms the hash value again and compares it with the hash value contained in the software to be loaded and/or decrypts the software and/or the hash value by means of a public key. Since only a public key is used, no special requirements have to be taken into account with regard to keeping the key secret.

EXAMPLE 32

Particularly high security when checking the software can be achieved if the origin of an authorized source is checked by a protected component of the banknote processing machine 10, 11. To this end, a programmable logic module (not shown) may be connected to the control device 4, 40. Particular data and/or software to be protected can be stored in the programmable logic module, along with the fundamental software for controlling the banknote processing machine 10, 11 and the control unit 4, 40 thereof, which is referred to, for example, as firmware as described above. One component of the firmware may also be the software item, which is used to check software to be loaded via the interface 6, 42, as described above. Storage of the software to be loaded in the non-volatile memory 5, 41 takes place only once a check has been carried out by the logic module. Of course, secret data may be stored and given particular protection in the logic module, for example, secret keys and/or also the public key described above.

The programmable logic module may be formed, for example, by a CPLD (Complex Programmable Logic Device) or an FPGA (Field Programmable Gate Array). Such a programmable logic module is programmed such that connections are defined between gates of the programmable logic module. This programming may be performed using a design created by a user, in which the connections of the gates are defined in order thus to determine the function of the programmable logic module. The auxiliary programs used for programming of the logic modules also contain mechanisms for protecting the design that has been created. The programming of the logic modules usually takes place by means of a binary data stream, which is interpreted within the logic modules. The format of the programming data used is kept secret, in order to make it very difficult or impossible to translate the design back and thus analyse it.

Programmable logic modules, which are programmed just once because they permanently store the connections defined during the programming operation are also protected by an internal protection circuit to prevent reading of the data. Copying of the design to an identical programmable logic module can thus be prevented, which results in a particularly high level of protection for the data. The data are stored within the described secure environment in the programmable logic module and can be made available only by the latter for further processing.

The software to be loaded consists of an identification part and the actual software. The identification part contains the identifier of the authorized source. The identifier may be, for example, the above-described hash value, which may also be encrypted. As described above, the actual software may consist of programs, which control the banknote processing machine 10, 11 by means of the control device 4, 40. Data may additionally be contained, which are used, for example, as the above-described comparison data for evaluating the signals of the sensor device 3, 30. Advantageously, in the event of altered or new programs the associated data will always be contained in the software, and in the event of altered or new data the associated programs will always be contained in the software. In this way it is possible to prevent compatibility problems, which could otherwise occur if data and/or programs of an older version, which are already stored in the non-volatile memory 5, 41 are used together with programs and/or data of a newer version, which are loaded and written to the non-volatile memory 5, 41.

EXAMPLE 33

The software can still be checked to see whether it originates from an authorized source even when the software is read from the non-volatile memory 5, 41 by the control device 4, 40 in order to be run.

Fee-Payable Software

In one advantageous embodiment, it is furthermore provided that a proof of payment for using the software, data, etc. is generated on certain banknote processing machines 10, 11, wherein the software is permanently stored and/or run only if the proof of payment exists.

EXAMPLE 34

The proof of payment may, for example, be formed in that an individual identifier is contained in the identification part, said identifier corresponding to an individual identifier of a certain banknote processing machine 10, 11 and being stored, for example, in the non-volatile memory 5, 41 or in the above-described logic module. During a loading operation, the individual identifier contained in the identification part is compared with the individual identifier of the banknote processing machine 10, 11 by the control device 4, 40 or the logic module. Only if the two individual identifiers are the same is the software stored in the non-volatile memory 5, 41. In this way, it is possible for software to be loaded and stored in a targeted manner only in one specific banknote processing machine 10, 11. This ensures inter alia that a corresponding fee has been or will be paid for fee-payable software.

EXAMPLE 35

The identification part may furthermore contain a common identifier, which corresponds to a common identifier of a number of banknote processing machines 10, 11 and which is stored, for example, in the non-volatile memory or in the above-described logic module. During a loading operation, the common identifier contained in the identification part is compared with the common identifier of the respective banknote processing machine 10, 11 by the control device 4, 40 or the logic module. Only if the two common identifiers are the same is the software stored in the non-volatile memory 5, 41. In this way, it is possible for software to be loaded and stored in a targeted manner only in a specific group of banknote processing machines 10, 11, which all have the same common identifier. This ensures inter alia that a corresponding fee has been or will be paid for fee-payable software, since it is known how many banknote processing machines 10, 11 belong to the group of banknote processing machines 10, 11 having the same common identifier.

EXAMPLE 36

The software can also still be checked to see whether a fee has been paid even when the software is read from the non-volatile memory 5, 41 by the control device 4, 40 in order to be run.

EXAMPLE 37

The payment of the fee can also be ensured if, during the transmission of software to a specific banknote processing machine 10, 11, the service centre 100 determines the identity of the specific banknote processing machine 10, 11 based on the identification data thereof and charges the operator the corresponding fee. A fee may not be charged, for example, if the operator has concluded a contract concerning the updating of software for which said operator makes monthly payments for example.

EXAMPLE 38

It may also be provided that the banknote processing machine 10, 11 sends an activation report to the service centre 100 via the interface 6, 42 and the network 60 the first time the new software is activated. The service centre 100 then charges the operator for this new software, as described above. In order to ensure that the activation report from the banknote processing machine 10, 11 is actually sent to the service centre, it may be provided that a confirmation is sent by the service centre 100 to the banknote processing machine 10, 11, without which the new software cannot be run. The confirmation from the service centre 100 may be, for example, a password or a key.

EXAMPLE 39

The payment of the fee may also be achieved in that the operator purchases a certain amount of credit from the manufacturer or the service organization 106, and said credit is reduced each time new software is stored in the non-volatile memory 5, 41 or run for the first time. To this end, a chip card 14 may be inserted, on which the credit is stored. The described reduction in credit may be carried out by means of the identification unit 13 connected to the banknote processing machine 10, 11.

EXAMPLE 40

In a further possibility for ensuring the payment of a fee for new software, it may be provided to charge for the use of the new software. To this end, an appropriate amount is charged each time the software is run during operation of the banknote processing machine 10, 11. This may be achieved, for example, as described above, in that an activation report is sent to the service centre 100 or in that the appropriate amount is debited from the chip card 14. Calculation of the appropriate amount may take place, for example, on the basis of the functionality used, for example, the sorting of banknotes, and/or the throughput, for example, the number of banknotes processed.

EXAMPLE 41

As a special feature, it may be provided that new software is made available by the service centre 100 for trial purposes. In this case, the new software is stored in the non-volatile memory 5, 41 and can be run for a certain time and/or for a certain number of processing operations. If the operator of the banknote processing machine 10, 11 pays the required fee, the new software can continue to be used following expiry of the trial period or once the specified number of processing operations has been exceeded. If the payment is not made, the original status of the banknote processing machine is restored. This may be effected, for example, in the manner described above, in that the current software status of the banknote processing machine 10, 11 is stored, for example, in the service centre 100, prior to storage of the new software in the non-volatile memory 5, 41.

Updating of Comparison Data

It has already been described above that the comparison data used to detect the type and authenticity and also to assess the condition of the banknotes BN to be processed are of critical importance. With the present system consisting of service centre 100, network 60 and banknote processing machines 10, 11, the comparison data of all the banknote processing machines 10, 11 can be constantly updated, for example, by means of the above-described distribution of software, which may also contain comparison data. In addition, it is possible to use the system to adapt and/or alter the comparison data and/or to generate additional comparison data if, for example, counterfeit banknotes of a certain currency and denomination are found.

The generation of comparison data is usually performed, as described above, by the department 102 for adapting comparison data. Here, the banknotes of various currencies to be processed are examined and corresponding comparison data are produced for each denomination of each currency.

EXAMPLE 42

If a new type of counterfeit is found during the processing of banknotes BN at a banknote processing machine 10, 11, or if banknotes of a currency for which no comparison data are available in the non-volatile memory 5, 41 and in the service centre 100 are processed, the operating person or the operator of the banknote processing machine 10, 11, or the service centre 100, can start a special processing mode, for example, by means of the input/output device 12, 45. In this case, it may be necessary for the operating person to prove that he is authorized to activate the special processing mode, for example, by means of the card 14.

In the special mode of operation, the operating person is asked to place the new type of counterfeit or the banknotes of the currency, which is not yet known in the input compartment 1, 21 of the banknote processing machine 10, 11. The new type of counterfeit or the banknotes of the unknown currency are then processed by the banknote processing machine 10, 11 in the manner described above. The data of the sensor device 3, 30 are transmitted via the interface 6, 42 and the network 60 to the service centre 100 in an unprocessed form or in a form processed by the control device 4, 40, for example, in compressed form, and are stored in the data memory of the service centre 100. Once processing of the counterfeit or of the banknotes of the unknown currency is complete, the operating person may be asked to insert the counterfeit or the banknotes of the unknown currency again, for example, in order for the sensor device 3, 30 to be able to detect the banknotes in all four possible positions so as to generate corresponding data for each of the possible positions.

The data of the counterfeit or of the banknotes of the unknown currency, which are stored in the data memory of the service centre 100 are evaluated in order to produce comparison data. This may be carried out automatically by the service centre 100 or by the department 102 for adapting comparison data. However, it is also possible for an expert from the department 102 for adapting comparison data to perform the evaluation of the data, or to control the latter, in order to produce the comparison data. In order to assist the expert from the department 102 for adapting comparison data in his assessments, or to facilitate the latter, it may also be provided that images of the banknote to be assessed in each case are transmitted from the banknote processing machine 10, 11 to the service centre 100 or the department 102 for adapting comparison data via the internal network 105. The images of the banknote to be assessed in each case may be generated from the data of the sensor device 3, 30; however, use may also be made of a special camera or a scanner. The expert from the department 102 for adapting comparison data may also issue instructions to the operating person of the banknote processing machine 10, 11 via the network 60, in order, for example, to again generate data for certain banknotes. The instructions may in particular be given acoustically and/or optically, for example, by means of a telephone with picture display, which can be embodied by the network 60 as Internet telephony, wherein the acoustic and/or optical instructions can be displayed to the operating person by means of the display and a loudspeaker of the input/output device 12, 45 of the banknote processing machine 10, 11. It is also possible for the expert from the department 102 for adapting comparison data to control the banknote processing machine 10, 11 directly via the network 60 in order to obtain data concerning the counterfeit or banknotes of the unknown currency.

The comparison data produced are stored in the data memory of the service centre 100 and made available via the network to the banknote processing machine 10, 11 and stored in the latter in the non-volatile memory 5, 41 thereof. Since the comparison data produced are stored in the data memory of the service centre 100, they are also available to the other banknote processing machines 10, 11.

EXAMPLE 43

In a manner differing from the above description, in which the comparison data are produced by evaluating the data of the counterfeit or of the banknotes of the unknown currency in the service centre 100, it is also possible for the comparison data to be produced by the banknote processing machine 10, 11, which to this end is operated by the operating person. The production of the comparison data may be effected automatically by evaluation of the data of the counterfeit or of the banknotes of the unknown currency by the control device 4, 40. However, control by an expert is also possible, said expert being connected to the banknote processing machine 10, 11 via the network 60. However, the expert may also be present at the site of the banknote processing machine 10 and may use a service computer 50, which is connected to the banknote processing machine 10. The expert on site may also use the input/output device 12, 45 of the banknote processing machine 10, 11. In this case, it may be necessary for the expert to identify himself by means of a card 14.

The comparison data produced in this way are stored in the non-volatile memory 5, 41 of the banknote processing machine 10, 11. In addition, the comparison data may be transmitted via the network to the service centre 100, in order to be stored in the data memory of the latter. The comparison data are then also available to the other banknote processing machines 10, 11.

EXAMPLE 44

When new types of counterfeit arise, it is particularly effective to produce additional comparison data for the new types of counterfeit and to use these together with the already existing comparison data in such a way that the checking of banknotes takes place on the basis of the already existing comparison data and the additional comparison data.

During the processing of banknotes BN by the banknote processing machine 10, 11, the banknotes BN to be processed are then compared both with the comparison data already present in the non-volatile memory 41 and also with the additional comparison data generated subsequently for the new types of counterfeit. If, based on the comparison data for new types of counterfeit, banknotes are recognized as counterfeits, these are identified as counterfeits in accordance with the customary procedure and are dealt with accordingly, for example, are placed in the special output compartment 25.

It is obvious from the above description that, for each new type of counterfeit, comparison data have to be derived from the respective new type of counterfeit, generated and made available to the banknote processing machines 10, 11. However, it is also possible to take account of a number of new types of counterfeit at the same time and to generate common additional comparison data for these. In this case, it is particularly advantageous to combine new types of counterfeit with common additional comparison data, which relate to banknotes of a certain type, for example, new types of counterfeit of banknotes of a certain currency and denomination, e.g. £50 banknotes.

The checking of the banknotes can be carried out more effectively if the control device 40 first determines, in the banknote processing machine 10, 11, which type of banknote is involved, that is to say the currency to which the banknote belongs and the denomination thereof. If, when checking the authenticity of the banknote using the comparison data originally available in the non-volatile memory 5, 41, it has already been ascertained that the banknote is a counterfeit, there is no need for any further checking. If this is not the case, a targeted check is then made to ascertain whether additional comparison data for new types of counterfeit are available for the determined type of banknote (currency, denomination). If no comparison data are available, the check can be terminated. If comparison data for one or more new types of counterfeit are available, the corresponding comparison data can be compared with the data of the sensor device 3, 30 for the respective banknote in order to ascertain whether the respective banknote is a counterfeit.

However, it is also possible that firstly the check of the data of the sensor device 3, 30 of the respective banknote with the additional comparison data for new types of counterfeit is carried out, followed by the check with the original comparison data.

The described embodiments and examples for the production of comparison data have the advantage that the comparison data are available to all the banknote processing machines 10, 11 within a very short time. This is made possible with very little use of personnel, since the process of producing the comparison data is carried out largely automatically. These advantages mainly result from the fact that the new counterfeits, or the banknotes of the unknown currency, do not have to be transported to the service centre 100 or to the department 102 for adapting comparison data.

EXAMPLE 45

The distribution of the new comparison data can be further accelerated if the service centre 100 actively transmits the newly produced comparison data to further banknote processing machines 10, 11 as soon as said data are available in the data memory of the service centre 100.

Alarm Messages

Further protection of operation of the banknote processing machines 20, 22, in particular of the banknote processing machines 10 used for the paying-in of banknotes, can be achieved if alarm messages are generated, for example, when counterfeit or suspect banknotes are found.

The alarm messages can be sent via the network 60 to other banknote processing machines 10, 11, in order to warn them, for example, about certain counterfeits. The alarm messages can also be sent to an official authority, which is connected to the network 60, for example, a police authority.

EXAMPLE 46

If, when a banknote is paid into a banknote processing machine 10, said banknote is classed as counterfeit or suspect, the banknote BF is transported to the special storage compartment 8 and stored there. At the same time, information about the banknote BF and the reason why it has been classed as counterfeit are sent to the service centre 100. The information may be, for example, the type of banknote BF, that is to say the currency and denomination. The reasons for it being classed as counterfeit concern in particular the differences between the data of the banknote BF that are generated by the sensor device 3 and the comparison data available in the non-volatile memory 5.

At the same time, personal data concerning the paying-in person can be detected by the banknote processing machine 10 and forwarded to the service centre 100. The personal data may be the data contained on the card 14. In addition, further personal data can be detected and sent to the service centre 100, for example, an image of the paying-in person, which has been recorded by a camera arranged in the banknote processing machine 10.

In the service centre 100, the data from the banknote processing machine 10 are evaluated. During this, a check may be carried out to ascertain whether certain persons have already frequently appeared because they have paid in counterfeit or suspect banknotes. A check can also be carried out to ascertain whether a certain counterfeit frequently occurs within a certain time period and/or a certain region. Based on the evaluation, the service centre 100 decides whether and which measures must be initiated to prevent or suppress as quickly as possible the distribution of counterfeit money.

By way of example, the service centre 100 may cause new comparison data to be generated in the manner already described above.

The service centre 100 can also inform the banknote processing machines 10, 11 via the network 60 about the counterfeits that have been found. In this case, the person paying in the counterfeit may be prevented from paying in any further banknotes. To this end, the data from the card 14 of the person and/or the image thereof is transmitted to the other banknote processing machines 10, 11. However, the service centre may also cause the paying-out of certain banknotes, that is to say banknotes of a certain currency and denomination, to be refused by the banknote processing machines 10, 11, or may cause such banknotes to be confiscated and stored, for example, in the special storage compartment 8.

Moreover, it may be provided that the person's data are sent by the service centre 100 via the network 60 to the aforementioned official authority. In parallel, or in addition, the person's data may also be sent to other locations, which are connected to the network 60 and at which banknotes may be paid out or paid in, for example, banks, petrol stations and shops, in order to warn the latter.

Besides preventing the distribution of counterfeits in the aforementioned manner, the procedure described above can be used in general for any conceivable type of manipulation, which is possible in connection with the paying-in of banknotes.

Services

In order to permit and facilitate service operations by a service person on site at the banknote processing machine 10, 11, the service person may use a computer 50 or the input/output device 12, 45 as described above.

EXAMPLE 47

The service person establishes a connection to the service centre 100 via the network 60. The respective banknote processing machine 10, 11 and/or the service person is identified by means of their identification data and transmits current data, e.g. the aforementioned log files and/or statistics. The current data are compared with data stored in the data memory of the service centre 100, for example, older log files and/or statistics of the respective banknote processing machine 10, 11, or with predefined data, which have to be maintained by banknote processing machines 10, 11 of the respective type. The results of this comparison are sent by the service centre 100 via the network 60 to the respective banknote processing machine 10, 11 and can be used by the service person for the necessary service operations. By way of example, the service centre 100 may provide certain information as to which operations are to be carried out by the service person.

EXAMPLE 48

However, it is also possible that the service person requests certain data, comparison data, software, etc. from the service centre 100 in order to store these in the non-volatile memory 5, 41 of the banknote processing machine 10, 11. The service person can also place an order with the service centre 100 for certain replacement parts for the respective banknote processing machine 10, 11.

EXAMPLE 49

Once the service person has finished the operations on the respective banknote processing machine 10, 11, and, for example, has stopped the connection of the banknote processing machine 10, 11 via the network 60 to the service centre 100, changes to the stored data of the respective banknote processing machine 10, 11 that have been made by the operations carried out by the service person are transferred to and stored in the data memory of the service centre 100. In this way, the service centre 100 always knows the data necessary for operation of the respective banknote processing machine 10, 11.

In addition to or instead of the above-described storage of the data necessary for operation of the banknote processing machine 10, 11, the storage may also take place in a data memory of the service organization 106. There may also be stored in the data memory of the service organization 106 data, which are important only to the service organization 106, for example, data concerning the use of the service person at the respective banknote processing machine 10, 11, in order, for example, to create an invoice for the services provided and send it to the operator of the respective banknote processing machine 10, 11.

Fault Clearance by the Operating Person

To remove faults or to carry out simple service operations, it may also be provided that the operator and/or the operating person carries out the appropriate measures under the instruction of the service centre 100.

EXAMPLE 50

To this end, it may be provided that the banknote processing machine 10, 11 regularly sends the above-described log files and/or statistics to the service centre 100 via the network 60. It may also be provided that the data contained in the log files and/or statistics are examined by the control device 4, 40 of the banknote processing machine 10, 11 for any discrepancies or irregularities, such as, for example, the increase in double withdrawals, that is to say more than a single banknote is gripped by the separator 22 and transferred to the transport system 23. If discrepancies or irregularities are determined, the log files and/or statistics can be sent to the service centre 100. In the service centre 100, the log files and/or statistics are analysed.

Depending on the result of the analysis, the service centre 100 can initiate various measures to remove the detected fault or discrepancies.

EXAMPLE 51

If faults or discrepancies are detected, which can be removed without any intervention, a new software item, for example, is sent, which removes the detected faults or discrepancies. These may be newly developed programs; however, it is also possible for certain presets, data, etc. to be changed. The storage of the new programs and/or presets, etc. may also be carried out in a manner depending on the agreement of the operator or the operating person to the current programs and/or presents being changed.

EXAMPLE 52

In a next step, or in the case where the automatic analysis by the service centre 100 has not yielded any result, the expert department 103 can be brought in by the service centre 100. An expert in the expert department 103 then checks the available data of the respective banknote processing machine 10, 11 and initiates appropriate measures to remove the fault or discrepancy.

EXAMPLE 53

In a further step, it may be provided that the operator or the operating person of the respective banknote processing machine 10, 11 is informed by the service centre 100 or the expert department 103 to carry out certain measures. In order to carry out the measures, the operator or the operating person may receive instructions from the service centre 100 or the expert department 103. The instructions may be given acoustically and/or optically, for example, by means of Internet telephony as described above. It may also be provided that a camera in the banknote processing machine 10, 11 is used to transmit images of the banknote processing machine 10, 11 to the service centre 100 or to the experts of the expert department 103, in order to detect possible causes of faults on the basis of these images.

EXAMPLE 54

If replacement parts are required in order to remove the detected fault or discrepancy, the service centre 100 or the expert department 103 can initiate the dispatch of the necessary replacement parts. The required replacement parts can be delivered, for example, to the site of the respective banknote processing machine 10, 11.

EXAMPLE 55

If a service person should be required in order to remove the detected fault or discrepancy, the service centre 100 or the expert department 103 can notify the service person or the service organization 106 responsible for the service person and can supply all the information necessary to remove the detected fault. If replacement parts are required, these can optionally be delivered to the service person, the service organization 106 or the site of the respective banknote processing machine 100. Through control of the service centre 100, it can be ensured that the service person does not proceed to the site of the respective banknote processing machine 10, 11 until the necessary replacement parts are available. The service centre 100 or the service organization 106 may also make contact with the operator or operating person of the respective banknote processing machine 10, 11 in order to notify them of the arrival of the service person and/or to agree a time so that the service person can gain access to the banknote processing machine 10, 11.

EXAMPLE 56

However, it is also possible for the respective banknote processing machine 10, 11 to make contact with the service organization 106 via the network 60 in order to request a service person.

By virtue of the described measures, the situation can be achieved whereby the banknote processing machines 10, 11 operate more reliably since serious malfunctions can be detected early from increasing discrepancies, for example, it is possible to carry out any necessary repairs or to replace worn parts while the respective banknote processing machine is still functioning. As a result, breakdown of the banknote processing machine 10, 11 can be prevented.

Monitoring by the Operator

The obtaining of information from and the monitoring of banknote processing machines 10, 11 by the operators of the banknote processing machines 10, 11 is of particular importance.

EXAMPLE 57

To this end, as described above, it may be provided that the operator 110 of banknote processing machines 11, 11' has a computer 112, which said operator can use to obtain information about the banknote processing machines 11, 11' in order to monitor the banknote processing machines 11, 11'. For this, the operator 110 uses the computer 112 to set up a connection to the service centre 100 via the network 60. The setting-up of the connection and access to the data of the banknote processing machines 11, 11' of the operator is specially protected by the above-described measures, for example, by the use of passwords and secure connections. For data exchange between the operator 110 and the service centre 100, an individual user interface may be provided for the computer 112 or can be adapted by the operator 110 himself to his requirements.

The operator 110 can use his computer 112 to call up the data concerning the banknote processing machines 11, 11', which is stored in the service centre 100, e.g. log files containing status information and/or statistics. Information from the service centre 100 can also be evaluated by the operator 110, said information being based on the evaluation of the data concerning the banknote processing machines 11, 11' by the service centre 100 and/or the departments 101 to 104 connected to the service centre 100.

Based on the information and data concerning his banknote processing machines 11, 11', which are made available to the operator 110 on the computer 112, the operator 110 can monitor his banknote processing machines 11, 11' and can start a wide range of processes in order to ensure, for example, the functionality of the banknote processing machines 11, 11'. By way of example, new software can be requested from the service centre 100 for one or more of the banknote processing machines 11, 11'. Replacement parts and/or a service person can be ordered, either from the service centre 100 or from the service organization 106. Enquiries can be sent to the departments 101 to 104, for example, the creation of an offer for new banknote processing machines by the sales and marketing department 104.

EXAMPLE 58

In addition, it may be provided that data concerning the banknote processing machines 11, 11' of an operator 110 are stored and evaluated not only in the data memory of the service centre 100, but also in the computer 112 of the operator 110. These may additionally be data, which are stored and evaluated only in the computer 112, for example, because these are confidential data such as names and account details of paying-in persons when the banknote processing machines 10, 11 operated by the operator are, for example, the automatic teller terminals described above.

EXAMPLE 59

If automatic teller terminals 10 are operated by the operator, further data may concern the cassettes 9 of the automatic teller terminals 10. These data may show, for example, whether the cassettes 9 that are used are empty or full or still contain only a small quantity of banknotes or already contain a large quantity of banknotes, which almost corresponds to the maximum quantity, so that replacement of the full or empty cassettes 9 is required. Replacement of the cassettes 9 may be initiated by the service centre 100 or the computer 112 of the operator, for example, an operating person for the automatic teller terminal 10 may be asked to do this, said operating person being located at the site of the automatic teller terminal 10, for example, a bank branch. The service organization 106 may also be asked. At the time of replacement of the cassettes 9, the data stored in the non-volatile memory 5 of the automatic teller terminal 10 concerning the number and type (currency, denomination) of banknotes BA contained in the replaced cassette 9 are also transmitted via the network 60 to the service centre 100 or the computer of the operator. Further data may concern the individual paying-in and/or paying-out processes and may include information concerning the person paying in and/or taking out banknotes and also the number and type (currency, denomination) of the banknotes paid in and/or taken out.

When banknotes are paid into an automatic teller terminal 10, the banknotes BF, which are recognized as counterfeit or suspect are also particularly important, and these are retained in the storage compartment 8 and removed from the storage compartment 8 in the usual way when replacing the cassettes 9 as described above.

The removed counterfeit or suspect banknotes BF are transported with the cassettes 9 to a processing station of a bank or of a security transport company. The processing station consists essentially of a banknote processing machine 11 for evaluating and sorting banknotes. By means of the banknote processing machine 11, the banknotes BA contained in the cassettes 9 are processed and the data determined in the process are compared with the data originating from the automatic teller terminal 10 in order to check whether the contents of the cassettes 9 correspond to the transmitted data.

Identification of Counterfeit or Suspect Banknotes

However, particular problems arise when checking the counterfeit or suspect banknotes BF. This is because these banknotes BF should be assigned at all times, that is to say in particular during the checks carried out in the processing station, to the person who paid in the banknotes BF in order to be able to check who paid the banknote in if it should in fact be found that said banknote is a counterfeit. It is therefore necessary for each of the banknotes BF to be clearly identified.

EXAMPLE 60

In order to identify counterfeit or suspect banknotes BF paid in at automatic teller terminals 10, the data obtained by the sensor device 3 during the above-described checking of the banknotes BF are stored in the non-volatile memory 5 along with the identity of the paying-in person who identifies himself by means of the card 14, for example, as described above. The data and the identity of the paying-in person are transmitted via the network 60 to the service centre 100 and/or the banknote processing machine 11 of the processing station. The identification of the individual banknotes BF is then achieved in that the suspect and/or counterfeit banknotes BF are processed by means of the banknote processing machine 11, wherein data for the suspect and/or counterfeit banknotes BF are generated by the sensor device 30. The generated data are then compared with the data transmitted via the network 60, and it is ascertained, which of the transmitted data items have the greatest correspondence with the respectively generated data. Finally, the respective suspect and/or counterfeit banknote can be identified by means of the identity of the paying-in person, which is assigned to the transmitted data items having the greatest correspondence.

It is obvious that, for such a procedure, it is necessary that the sensor device 3 of the automatic teller terminal 10 must correspond to the sensor device 30 of the banknote processing machine 11, in order to be able to generate, for identification purposes, comparable data for the suspect and/or counterfeit banknotes BF. It is also possible that different sensor devices 3, 30 are used, but the respective data of at least one of the control devices 4, 40 is converted into a format, which allows a comparison of the data.

EXAMPLE 61

Since, following transport of the suspect and/or counterfeit banknotes BF, it is no longer easy to know in which of the four possible positions the suspect and/or counterfeit banknotes BF were detected by the sensor device 3 of the automatic teller terminal 10, it is advantageous to process the suspect and/or counterfeit banknotes BF in all four possible positions by the banknote processing machine 11 for identification purpose. It is thus ensured that the sensor device 30 of the banknote processing machine 11 generates data, which reliably make it possible to identify the suspect and/or counterfeit banknotes BF.

By virtue of the described identification procedure, it is ensured that suspect and/or counterfeit banknotes BF can be assigned to a paying-in process and/or to a paying-in person, without this assignment to the respective banknote BF having to be done at the time of the paying-in operation. As a result, no physical separation of suspect and/or counterfeit banknotes BF from different paying-in operations or from different paying-in persons is necessary. As a result, the logistical complexity in terms of handling the suspect and/or counterfeit banknotes BF can be considerably reduced. Moreover, the complexity required when producing the automatic teller terminal 10 can also be considerably reduced.

Customer Support

It is particularly important to provide support for the operator's customers who perform transactions at banknote processing machines 10, 11, in particular at automatic teller terminals 10. It is also advantageous to inform the customers of the possibility of configuring the automatic teller terminal 10 to the requirements of the respective customer, in order to allow efficient working with the automatic teller terminal 10.

EXAMPLE 62

For each customer, specific configuration data can be defined, which specify, for example, a particular user interface of the input/output device 12, 45. This may concern in particular the language used by the customer or preferred modes of operation, such as the paying-in or paying-out of a certain amount of money. The configuration data of the customer are stored in the non-volatile memory 5, 41 of the banknote processing machine 10, 11 and can be sent via the interface 6, 42 and the network 60 to the service centre 100 and/or the service organization 106 and/or the computer 112 of the operator 110 and stored therein. In this way, it is possible for the customer to operate each banknote processing machine 10, 11 with the configuration preferred by him. To this end, the customer identifies himself at the respective banknote processing machine 10, 11, for example, by means of his individual card 14. If the configuration data for this customer are contained in the non-volatile memory 5, 41 of the respective banknote processing machine 10, 11, they are used for the customer and the corresponding adjustments are made to the banknote processing machine 10, 11. If the configuration data are not contained in the non-volatile memory 5, 41, these are loaded from the service centre 100 and/or the service organization 106 and/or the computer 112 of the operator 110 via the network 60 by means of the customer's identity, and are used during operation of the banknote processing machine 10, 11 by the identified customer. Of course, the configuration data may also be stored in the non-volatile memory 5, 41 for subsequent uses. If the configuration data are stored in the non-volatile memory 5, 41, before each use of the configuration data a check may be provided in order to ascertain whether a more recent version of the configuration data is available in the service centre 100 and/or the service organization 106 and/or the computer 112 of the operator 110. It may also be provided that the configuration data in the service centre 100 and/or the service organization 106 and/or the computer 112 of the operator 110 are updated if the customer has made changes to the configuration data during the transactions on a banknote processing machine 10, 11.

EXAMPLE 63

The configuration may be also be carried out by the customer independently of the banknote processing machine 10, 11, for example, by means of a computer, which is connected via the network 60 to the service centre 100. The configuration data that are created are transmitted to the service centre 100 and are stored in the data memory of the service centre 100. As described above, the configuration data are then available for the respective customer when he identifies himself at a banknote processing machine 10, 11 at a subsequent point of time.

EXAMPLE 64

It may also be provided that the customer uses a suitable device to operate the banknote processing machine 10, 11, for example, a mobile telephone, a PDA (Personal Digital Assistant), etc. The operating device is preferably connected in a wireless manner to the banknote processing machine 10, 11, for example, via an infrared or Bluetooth connection. As described above, the user interface in particular may be adjusted according to the customer's wishes. The configuration data required for this are then additionally stored in a non-volatile memory of the customer's operating device, so that they are available at all times. Besides the function of operating banknote processing machines 10, 11, the customer's device may also have other functions, for example, travelcard, payment means, access authorization, etc.

EXAMPLE 65

Besides the described setting of the configuration data by the customer, it may also be provided that the configuration data are set by the service centre 100 and/or the service organization 106 and/or the operator 110 or the computer 112 of the latter. To this end, configuration data are prescribed for each type of banknote processing machine 10, 11. These configuration data may be changed for individual banknote processing machines 10, 11, for example, because the particular situation at the site of the banknote processing machine 10, 11 makes this necessary, for example, the illumination of the display of the input/output device 12, 45 may be set to be particularly bright because direct sunlight strikes the display at the site of the banknote processing machine 10, 11. Further adaptations of the configuration data can be carried out by the service centre 100 and/or the service organization 106 and/or the operator 110 when changes to the status of the banknote processing machine 10, 11 are determined, for example, when the failure of certain parts of the banknote processing machine 10, 11 is ascertained during the evaluation of the log files and/or statistics.

EXAMPLE 66

If the customer would like help in setting his configuration data, he can request assistance from the service centre 100. An expert from the service department 103 then assists the customer in setting his configuration data. It is also possible for a service person of the service operation 106 to help the customer. This may be effected, for example, in that the expert from the service department 103 connects to the user interface of the banknote processing machine 10, 11 via the network 60 and performs the settings together with the customer. Instead of this, or in addition, it may be provided that the expert from the service department 103 transmits optical and/or acoustic instructions to the customer via the network 60, for example, by means of the Internet telephony mentioned above.

EXAMPLE 67

The customer may also be assisted by the expert from the service department 103 or by the service person from the service organization 106 if malfunctions occur on the banknote processing machine 10, 11. In this case, it may be provided that the malfunction is detected by the banknote processing machine 10, 11 and the assistance of the expert from the service department 103 is requested by the banknote processing machine 10, 11 via the network 60. It may also be provided that the service centre 100, through the above-described evaluation of log files and/or statistics of the banknote processing machine 10, 11, detects the malfunction and automatically informs the expert from the service department 103 so that said expert assists the customer. However, a special Help button may be provided on the banknote processing machine 10, 11, which makes it possible for the customer to make contact with the service centre 100 or with the expert from the service department 103. The expert from the service department 103 can give the customer optical and/or acoustic information in particular via the network 60, for example, by means of Internet telephony. By way of example, the expert from the service department 103 can inform the customer that a service person has been notified and is on his way to the banknote processing machine 10, 11, that a certain transaction or debit process has or has not been carried out, that the customer's card 14 has been saved or blocked for certain reasons, that the customer should or should not wait at the banknote processing machine 10, 11, etc.

EXAMPLE 68

The customer can also receive assistance from the expert from the service department 103 or from the service person of the service organization 106 if problems arise during operation of the banknote processing machine 10, 11. To this end, the customer can use the above-described Help button. It is also possible for incorrect operation of the banknote processing machine 10, 11 by the customer to be recorded by the banknote processing machine 10, 11 or the service centre 100, for example, by repeated incorrect inputs of operating commands by the customer, whereupon the expert from the service department 103 is informed. The expert from the service department 103 will then make contact with the customer via the network 60, acoustically and/or optically, for example, by means of Internet telephony, in order to assist the customer in operating the banknote processing machine 10, 11. To this end, the expert from the service department 103 can issue vocal instructions as to which operating elements of the input/output device 12, 45 should next be pressed by the customer. However, the expert from the service department 103 can also carry out the necessary steps on the banknote processing machine 10, 11 via the network 60. The expert from the service department 103 can also transmit general information, for example, that the customer should wait until a service person arrives, that the card 14 has been confiscated, etc.

It is obvious that the described embodiments and/or the detailed examples of the description and also the claims may in each case be used individually, but also in any combination with one another, for a system of banknote processing machines, banknote processing machines and methods for operating same.

The invention claimed is:

1. System comprising at least one banknote processing machine, which is connected to a service centre by means of a network, wherein the system is configured so that data necessary for operation of the at least one banknote processing machine and/or data produced during operation of the at least one banknote processing machine are exchanged between the banknote processing machine and the service centre via the network, and wherein log files or statistics about increasing deviations or irregularities occurring during operation of the at least one banknote processing machine are transmitted to the service centre over the network, and the service centre evaluates the log files or statistics about a fault, and when a fault has occurred during the operation of the at least one banknote processing machine, the service centre initiates and causes repairs to be carried out or wearing parts to be replaced before the at least one banknote processing machine fails.

2. The system according to claim 1, wherein the exchanged data comprise software.

3. The system according to claim 1, wherein the exchanged data comprise comparison data and/or presets.

4. The system according to claim 1, configured so that the data from the service centre fully or partially replaces and/or enhances the data in the banknote processing machine.

5. The system according to claim 4, configured so that, when a fault has occurred and/or when a fault report has been received from the banknote processing machines, the service centre generates instructions to remove this fault and provides said instructions to the respective banknote processing machine.

6. The system according to claim 1, configured so that the network comprises the Internet.

7. The system according to claim 1, wherein the banknote processing machine and the service centre have an interface for connection to the network.

8. The system according to claim 1, wherein a number of banknote processing machines are connected to one another, wherein the exchange of data with the service centre takes place via one of the banknote processing machines and/or via the connection of the banknote processing machines.

9. The system according to claim 1, wherein one or more banknote processing machines are assigned to an operator that is able to monitor and/or control the banknote processing machines by means of a monitoring unit.

10. The system according to claim 9, wherein the exchange of data between the service centre and the banknote processing machines, a service organization, and the operator, uses a standard protocol.

11. The system according to claim 1, wherein data from banknote processing machines and/or operators are stored in a data memory of the service centre.

12. The system according to claim 1 or 9, wherein the service centre is arranged to evaluate the data of operators.

13. The system according to claim 1, wherein the service centre is connected to departments.

14. The system according to claim 13, wherein the departments are arranged to provide data to the service centre.

15. The system according to claim 13, wherein the departments are arranged to evaluate data from the service centre.

16. The system according to claim 13, wherein each department is arranged to access data of the other departments.

17. The system according to claim 13, wherein the departments are arranged to request data from the banknote processing machines.

18. The system according to claim 13, wherein the departments are arranged to provide data to the banknote processing machines.

19. The system according to claim 13, wherein one of said departments is arranged to provide software for operation of the banknote processing machines.

20. The system according to claim 13, wherein one of said departments is arranged to provide comparison data for the banknote processing machines.

21. The system according to claim 13, wherein one of said departments is arranged to provide data and/or software and/or information for repairing and/or servicing the banknote processing machines.

22. The system according to claim 13, wherein one of said departments is arranged to provide information concerning the banknote processing machines.

23. The system according to claim 1, including at least one further service centre connected to the network.

24. The system according to claim 1, wherein at least one service organization and/or service person is connected to the service centre via the network.

25. The system according to claim 1, wherein the service centre is arranged to provide a trial version of the data for the banknote processing machines, which is usable by the banknote processing machines only for a limited time and/or for a predetermined number of uses.

26. The system according to claim 1, configured so as to enable operators and/or service organizations and/or banknote processing machines to search for information and/or data from the service centre in a targeted manner.

27. The system according to claim 1, 9 or 13, wherein the service centre and/or the departments communicate via the network with the operators and/or the service organizations and/or service personnel, in particular by means of graphic signals and/or text signals and/or image signals and/or sound signals.

28. The system according to claim 1, wherein the service centre is arranged to request data from the banknote processing machines.

29. The system according to claim 1, wherein the service centre is enabled to adjust and control the banknote processing machines.

30. The system according to claim 1, wherein the banknote processing machines are arranged to request data from the service centre.

31. The system according to claim 1, wherein the service centre is enabled to charge fees for transmitting data to the banknote processing machines.

32. The system according to claim 1, wherein the service centre is arranged to provide individual presets for each of the banknote processing machines.

33. The system according to claim 32, wherein each of the banknote processing machines is arranged to check whether new individual presets are available from the service centre and, if so, to use these new presets.

34. The system according to claim 1, configured so that adjustments to the respective banknote processing machine are undertaken by the banknote processing machine depending on the location.

35. The system according to claim 1, wherein the banknote processing machines are arranged to send fault reports to the service centre and/or the service organization and/or an operator.

36. The system according to claim 35, wherein any faults that have occurred are displayed by the banknote processing machines by means of an input/output device.

37. The system according to claim 1, configured so that the service centre and/or a service organization and/or an operator request fault reports from the at least one banknote processing machine.

38. The system according to claim 1, configured so that, for certain operating processes and/or fault clearance operations, the presence of one or more persons is absolutely necessary.

39. The system according to claim 38, arranged so that the presence of the person or persons is monitored.

40. The system according to claim 1, configured so that the service centre informs a service organization and/or a service person if certain faults occur on one of the banknote processing machines.

41. The system according to claim 40, arranged so that the service centre transmits to the service organization and/or to the service person information concerning the type of fault and/or concerning the measures to be carried out and/or concerning replacement parts that are required.

42. The system according to claim 1, arranged so that the service centre checks whether a banknote processing machine, a service organization and an operator are authorized to exchange data with the service centre.

43. The system according to claim 1, arranged so that the banknote processing machines, service organizations and operators check whether the service centre is authorized to exchange data with them.

44. The system according to claim 1, configured so that data from the service centre are loaded by a banknote processing machine if the data from the service centre are of a newer version.

45. The system according to claim 1, configured so that the exchange of data between the service centre and the banknote processing machines takes place at a specified point of time.

46. The system according to claim 1, configured so that the exchange of data between the service centre and the banknote processing machines is refused by the banknote processing machines.

47. The system according to claim 46, configured so that, if the exchange of data is refused by a banknote processing machine, the service centre takes control of the banknote processing machine in order to perform the exchange of data.

48. The system according to claim 1, wherein the data of the banknote processing machine are backed up prior to an exchange of data into the banknote processing machine and/or the service centre.

49. The system according to claim 48, configured so that the backed up data of the banknote processing machine can be used again or further if the exchange of data between the service centre and the banknote processing machine fails.

50. The system according to claim 1, configured so that fundamental parts of the data of the banknote processing machines cannot be altered by an exchange of data.

51. The system according to claim 1, wherein the banknote processing machines are arranged to check whether the data to be exchanged originate from an authorized source.

52. The system according to claim 1, wherein the banknote processing machines are arranged to check prior to each use of data whether the data to be used originate from an authorized source.

53. The system according to claim 1, configured so that data to be exchanged, that reflects a payment to be made, are identified, and exchange with the banknote processing machines is possible only if proof of such payment exists.

54. The system according to claim 53, configured so that the proof of payment is provided by an individual identifier of a banknote processing machine.

55. The system according to claim 53, configured so that the proof of payment is provided by an identifier for a number of banknote processing machines.

56. The system according to claim 1, configured so that data to be exchanged, that reflects a payment to be made, are identified, and use by the banknote processing machines is possible only if proof of such payment exists.

57. The system according to claim 1, configured so that an amount to be paid for data is set depending on the use of the data by the banknote processing machine.

58. The system according to claim 1, configured so that data concerning the banknotes processed by the banknote processing machines are transmitted to the service centre.

59. The system according to claim 58, configured so that comparison data are generated by the service centre from the data concerning the banknotes.

60. The system according to claim 59, configured so that comparison data generated by the service centre are exchanged with the banknote processing machines.

61. The system according to claim 1, wherein the service centre is arranged to generate an alarm message as a result of exchanging data with one or more of the banknote processing machines, which alarm message is sent to at least one of the banknote processing machines.

62. The system according to claim 61, configured so that the alarm message places the banknote processing machines in a special mode of operation.

63. The system according to claim 61, configured so that the alarm message contains further data, which are generated by the service centre and/or originate from the banknote processing machine(s) whose data triggered the generation of the alarm message.

64. The system according to claim 61, wherein the alarm message is generated when counterfeit or suspect banknotes are found.

65. The system according to claim 61, configured so as to enable a service person to set up by means of the banknote processing machines or a computer a connection via the network to the service centre and/or a service organization in order to request assistance and/or replacement parts.

66. The system according to claim 65, wherein enabled operations carried out by the service person are communicated via the network to the service centre and/or the service organization.

67. The system according to claim 66, configured so as to enable the service centre and/or the service organization to charge fees based on the operations communicated.

68. The system according to claim 1, configured so that the service centre informs an operating person if certain faults occur on one of the banknote processing machines.

69. The system according to claim 68, configured so that the service centre transmits information concerning the type of fault and/or concerning the measures to be carried out and/or concerning replacement parts that are required to the operating person.

70. The system according to claim 68, configured so as to enable the service centre to ask the operating person to deliver the necessary replacement parts to the location of the respective banknote processing machine.

71. The system according to claim 68, configured so that the service centre asks a department to provide data and/or software for clearing the fault on the banknote processing machines.

72. The system according to claim 71, configured so that the departments provide the data and/or software for clearing the fault on the banknote processing machines by text and/or graphically and/or optically and/or acoustically.

73. The system according to claim 1, configured so that, when certain faults occur, the service centre clears the faults via the network.

74. The system according to claim 1, configured so as to enable operating persons of the banknote processing machines to define specific configuration data.

75. The system according to claim 74, wherein the specific configuration data are stored in the banknote processing machine, the service centre and/or a service organization and/or a computer of the operator.

76. The system according to claim 75, wherein the stored specific configuration data are usable by an operating person of the banknote processing machines when this operating person operates the banknote processing machine.

77. Method for operating at least one banknote processing machine as well as a service centre, comprising the steps:

providing a system comprising at least one banknote processing machine, which is connected to a service centre by means of a network;

exchanging data necessary for operation of the at least one banknote processing machine and/or data produced during operation of the at least one banknote processing machine between the at least one banknote processing machine and the service centre via the network, including transmitting log files or statistics about increasing deviations or irregularities occurring during operation of the at least one banknote processing machine;

wherein the service centre evaluates the log files or statistics about a fault, and when a fault has occurred during the operation of the at least one banknote processing machine, the service centre initiates and causes repairs to be carried out or wearing parts to be replaced before the at least one banknote processing machine fails.

* * * * *